US011450450B2

(12) United States Patent
Hara et al.

(10) Patent No.: US 11,450,450 B2
(45) Date of Patent: Sep. 20, 2022

(54) INSULATED WIRE

(71) Applicant: ESSEX FURUKAWA MAGNET WIRE JAPAN CO., LTD., Tokyo (JP)

(72) Inventors: Natsuko Hara, Tokyo (JP); Keisuke Ikeda, Tokyo (JP); Daisuke Muto, Tokyo (JP)

(73) Assignee: ESSEX FURUKAWA MAGNET WIRE JAPAN CO., LTD., Tokyo (JP)

( * ) Notice: Subject to any disclaimer, the term of this patent is extended or adjusted under 35 U.S.C. 154(b) by 0 days.

(21) Appl. No.: 17/034,237

(22) Filed: Sep. 28, 2020

(65) Prior Publication Data

US 2021/0012926 A1 Jan. 14, 2021

Related U.S. Application Data

(63) Continuation of application No. PCT/JP2019/012352, filed on Mar. 25, 2019.

(30) Foreign Application Priority Data

Mar. 30, 2018 (JP) ..... JP2018-068758

(51) Int. Cl.
*H01B 7/02* (2006.01)
*H01B 3/42* (2006.01)
(Continued)

(52) U.S. Cl.
CPC ..... *H01B 7/02* (2013.01); *H01B 3/421* (2013.01); *H01B 13/06* (2013.01); *H01F 5/06* (2013.01)

(58) Field of Classification Search
CPC ..... C08J 9/26; C08J 2207/06; C08J 2377/00; H01B 13/06; H01B 3/447; H01B 3/46;
(Continued)

(56) References Cited

U.S. PATENT DOCUMENTS 310,879 A * 1/1885 Clark ..... H01B 7/226 174/105 R
2,284,400 A * 5/1942 Llewellyn ..... E04C 2/049 106/605
(Continued)

FOREIGN PATENT DOCUMENTS

CA 2910386 A1 * 10/2014 ..... H01B 13/065
CN 103650066 A 3/2014
(Continued)

OTHER PUBLICATIONS

International Search Report for PCT/JP2019/012352 (PCT/ISA/210) dated May 28, 2019.
(Continued)

*Primary Examiner* — Krystal Robinson
(74) *Attorney, Agent, or Firm* — Birch, Stewart, Kolasch & Birch, LLP

(57) ABSTRACT

An insulated wire comprising a conductor and a bubble-containing insulating layer, directly or indirectly coating the outer periphery of the conductor and containing a thermosetting resin, wherein the bubbles in the bubble-containing insulating layer include flattened bubbles whose oblateness in the cross-section perpendicular to the longitudinal direction of the insulated wire (lateral length of the bubble cross-sectional shape/vertical length of the bubble cross-sectional shape) is 1.5 or more and 5.0 or less.

6 Claims, 1 Drawing Sheet

(51) Int. Cl.
*H01B 13/06* (2006.01)
*H01F 5/06* (2006.01)

(58) Field of Classification Search
CPC ..... H01B 7/0208; H01B 7/02; H01B 7/0233; H01B 7/08; H01B 11/12; H01B 3/04; H01B 3/306; H01B 3/308; H01B 3/421; H01B 3/427; H01B 3/441; H01B 7/2813; H01B 11/06; H01B 11/08; H01B 13/0016; H01B 13/0036; H01B 13/08; H01B 13/16; H01B 1/026; H01B 3/12; H01B 3/16; H01B 3/30; H01B 3/302; H01B 3/307; H01B 3/36; H01B 3/40; H01B 3/48; H01B 7/00; H01B 7/0216; H01B 7/0838; H01B 7/18; H01B 7/24; H01B 7/26; H01B 7/2825; H01B 7/292; H01B 7/295; H01B 7/40; H01B 7/1875; H01B 13/141
See application file for complete search history.

(56) References Cited

U.S. PATENT DOCUMENTS 2,462,149 A * 2/1949 Webb ..... H01B 13/14 264/555
4,910,359 A * 3/1990 Dougherty ..... H01B 7/0823 174/110 V
5,115,103 A * 5/1992 Yamanishi ..... C08J 9/32 174/101.5
2011/0114870 A1* 5/2011 Yang ..... C08F 12/08 252/62
2011/0303487 A1* 12/2011 Caccia ..... H01B 7/1875 182/141
2013/0014971 A1* 1/2013 Muto ..... H01B 3/306 174/110 S
2014/0231695 A1* 8/2014 Doud ..... C04B 35/524 252/62
2015/0243410 A1* 8/2015 Knerr ..... H01B 7/0216 310/198
2016/0118159 A1* 4/2016 Mayama ..... H01B 13/143 174/107
2017/0004900 A1* 1/2017 Ishii ..... H01B 7/292
2018/0033518 A1* 2/2018 Ota ..... H01B 7/0208
2020/0126688 A1* 4/2020 Ikeda ..... H02K 3/34

FOREIGN PATENT DOCUMENTS

JP 59-80910 U 5/1984
JP 2012-224714 A 11/2012
WO WO 2015/137342 A1 9/2015
WO WO 2017/073551 A1 5/2017
WO WO 2017/138284 A 8/2017

OTHER PUBLICATIONS

Written Opinion of the International Searching Authority for PCT/JP2019/012352 (PCT/ISA/210) dated May 28, 2019.
Extended European Search Report for corresponding European Application No. 19777157.9, dated Nov. 22, 2021.
Chinese Office Action and Search Report for corresponding Chinese Application No. 201980087806.4, dated Apr. 1, 2021, with English translation of the Office Action.

* cited by examiner

INSULATED WIRE

CROSS-REFERENCE TO RELATED APPLICATIONS

This application is a Continuation of PCT International Application No. PCT/JP2019/012352 filed on Mar. 25, 2019, which claims priority under 35 U.S.C. § 119 (a) to Japanese Patent Application No. 2018-068758 filed in Japan on Mar. 30, 2018. Each of the above applications is hereby expressly incorporated by reference, in its entirety, into the present application.

TECHNICAL FIELD

The present invention relates to an insulated wire having a bubble-containing insulating layer.

BACKGROUND ART

In rotating electrical machines, such as motors for automobiles and for general industries, a demand has grown for high output and size reduction with high density. For such rotating electrical machines, insulated wires whose conductor is coated with an insulating layer are used.

From the demand for high output, measures against high voltage are required for the insulated wire used in the rotating electrical machine. For example, insulated wires with high dielectric breakdown voltage are required.

Further, a partial discharge easily occurs on the surface of the insulating layer due to application of high voltage. Therefore, suppression of deterioration due to the partial discharge is required. To suppress this deterioration, a rise in partial discharge inception voltage (PDIV) is important. As one of methods for increasing the partial discharge inception voltage, there is a method of lowering a relative permittivity of the insulating layer. As one of methods of lowering a relative permittivity, a method of making an insulating layer into a bubble-containing insulating layer is known.

Patent Literature 1 discloses insulated wires having a bubble-containing insulating layer, in which the insulated wire has a part whose thickness is thin in a length direction or a circumferential direction in an identical coating layer. Further, Patent Literature 2 discloses insulated wires having a porous insulating layer.

CITATION LIST

Patent Literatures

Patent Literature 1: WO 2015/137342 A1
Patent Literature 2: JP-A-2012-224714 ("JP-A" means unexamined published Japanese patent application)

SUMMARY OF INVENTION

Technical Problem

In the insulated wires having a bubble-containing insulating layer, the partial discharge inception voltage can be increased as compared to insulated wires having an insulating layer with no bubbles. However, dielectric breakdown voltage becomes relatively low.

The present invention is contemplated for providing an insulated wire having a bubble-containing insulating layer, which exhibits higher dielectric breakdown voltage than before, while maintaining a partial discharge inception voltage at a high level.

Solution to Problem

In order to solve the above-described problem, the present inventors conducted various studies. The present inventors found that by making the shape of bubbles in the insulating layer into a specific flattened shape, dielectric breakdown voltage can be increased, while maintaining a partial discharge inception voltage at a high level. The present invention has been completed on the basis of these findings.

The above-described problems of the present invention are solved by the following means.

[1]

An insulated wire comprising a conductor and a bubble-containing insulating layer, directly or indirectly coating the outer periphery of the conductor and containing a thermosetting resin, wherein the bubbles in the bubble-containing insulating layer include flattened bubbles whose oblateness in the cross-section perpendicular to the longitudinal direction of the insulated wire (lateral length of the bubble cross-sectional shape/vertical length of the bubble cross-sectional shape) is 1.5 or more and 5.0 or less.

[2]

The insulated wire described in the item [1], wherein the ratio of the number of the flattened bubbles among bubbles contained in the bubble-containing insulating layer is 50% or more.

[3]

The insulated wire described in the item [1] or [2], wherein the porosity of the bubble-containing insulating layer is 70% or less.

[4]

The insulated wire described in any one of the items [1] to [3], wherein the thermosetting resin is polyester, polyesterimide, polyimide, or polyamideimide, or a combination thereof.

[5]

The insulated wire described in any one of the items [1] to [4], having an outer non-bubble-containing insulating layer, directly or indirectly coating the outer periphery of the bubble-containing insulating layer.

[6]

The insulated wire described in any one of the items [1] to [5], wherein the thickness of the bubble-containing insulating layer is 10 μm or more and 250 μm or less.

[7]

The insulated wire described in any one of the items [1] to [6], wherein the flattened bubbles are formed by compression in the thickness direction of an insulating layer having bubbles.

Effects of Invention

In the insulated wires of the present invention, dielectric breakdown voltage is increased, while maintaining a partial discharge inception voltage. Therefore, the insulated wires of the present invention can be preferably used for electric instrument such as rotating electrical machines to which a high voltage is applied.

MODE FOR CARRYING OUT THE INVENTION

<<Insulated Wire>>

An insulated wire of the present invention comprises a conductor and a bubble-containing insulating layer, directly or indirectly coating the outer periphery of the conductor and containing a thermosetting resin. The bubble-containing insulating layer has bubbles, and the bubbles include flattened bubbles whose oblateness (defined by the following expression: Lateral length of bubble cross-sectional shape/Vertical length of bubble cross-sectional shape, and this is also referred to as bubble oblateness or simply as oblateness) in the cross-section perpendicular to the longitudinal direction of the insulated wire is 1.5 or more and 5.0 or less. Hereinafter, sometimes, an insulating layer having bubbles is referred to as "a bubble-containing insulating layer" and an insulating layer having the above-described specific flattened bubbles is referred to as "a flattened-bubble-containing insulating layer".

The expression "bubble-containing insulating layer directly coating the outer periphery of the conductor" means to have a bubble-containing insulating layer in contact with the outer periphery without providing any other layers (for example, an adhesive layer and an enamel layer) between the conductor and the bubble-containing insulating layer. On the other hand, the expression "bubble-containing insulating layer indirectly coating the outer periphery of the conductor" means to have a bubble-containing insulating layer on the conductor through other layer(s) provided between the conductor and the bubble-containing insulating layer.

Preferable embodiments of the insulated wire of the present invention are described with reference to the drawings.

Figure 1:
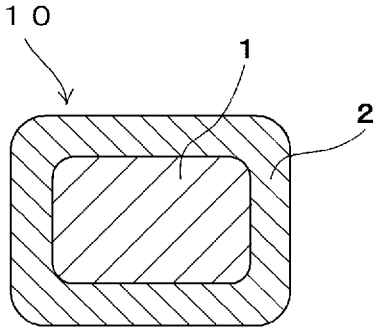
FIG. 1 is a cross-sectional view showing one embodiment of the insulated wire of the present invention.

One embodiment of the insulated wire of the present invention whose cross-sectional view is shown in FIG. 1 is an insulated wire 10 having a conductor 1 whose cross-section perpendicular to the longitudinal direction of the insulated wire is rectangle, and a flattened-bubble-containing insulating layer 2 that directly coats the outer periphery of the conductor 1.

Figure 2:
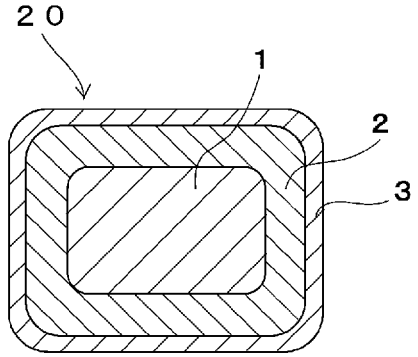
FIG. 2 is a cross-sectional view showing another embodiment of the insulated wire of the present invention.

Another embodiment (insulated wire 20) of the insulated wire of the present invention whose cross-sectional view is shown in FIG. 2 is the same as the insulated wire shown in FIG. 1, except for providing an outer non-bubble-containing insulating layer 3 directly on the outer periphery of the flattened-bubble-containing insulating layer 2.

Figure 3:
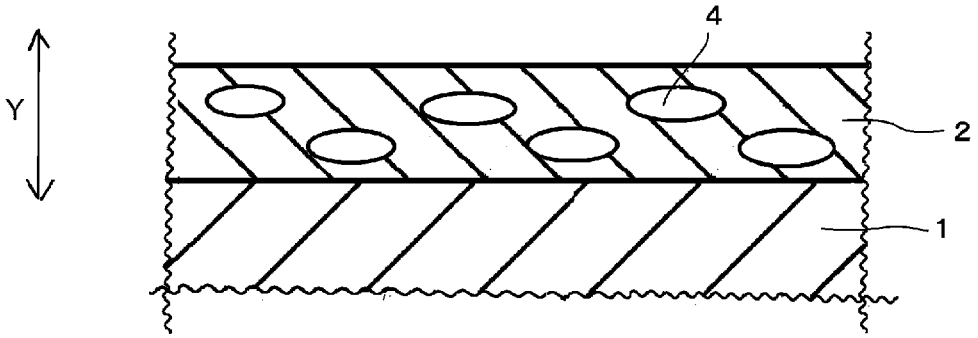
FIG. 3 is a partially enlarged schematic view showing one embodiment of a cross section perpendicular to the longitudinal direction in the insulated wire of the present invention.

FIG. 3 shows a schematic view in which a part of the flattened-bubble-containing insulating layer 2 and the conductor 1 shown in FIG. 1 is enlarged. The flattened-bubble-containing insulating layer 2 has flattened bubbles 4. Y shows a thickness direction of the flattened-bubble-containing insulating layer 2. In FIG. 3, bubbles have a regular arrangement. However, the present invention is not limited to this arrangement.

<Flattened-Bubble-Containing Insulating Layer>

The flattened-bubble-containing insulating layer has at least specific flattened bubbles described below.

Herein, the bubbles contained in the flattened-bubble-containing insulating layer may be closed bubbles or open bubbles or both of these bubbles. The closed bubbles mean bubbles namely no communicating opening portions with adjacent bubbles can be confirmed on inner walls of the bubbles, when a cross section of an insulated wire cut at an arbitrary cross section is observed by means of a microscope; and the open bubbles mean bubbles in which the communicating opening portions can be confirmed on the inner walls of the bubbles when observed in a similar manner.

Among the bubbles including the above-described independent bubbles (closed bubbles) and interconnecting bubbles (open bubbles), the flattened bubbles mean bubbles whose oblateness in the cross-section perpendicular to the longitudinal direction (direction of axis) of the insulated wire is 1.5 or more and 5.0 or less. By containing the flattened bubbles therein, dielectric breakdown voltage can be increased, while maintaining a partial discharge inception voltage. The oblateness that exceeds 5.0 sometimes makes it difficult to maintain the bubble shape and therefore is not practical.

The oblateness is preferably 1.5 or more and 3.0 or less, and more preferably 1.5 or more and 2.5 or less.

The flattened-bubble-containing insulating layer may have bubbles that do not meet the above-described oblateness, for example, bubbles whose cross-sectional shapes are a circular form, a shape of an ellipse (that does not meet the above-described oblateness), an indefinite shape, and the like.

The oblateness can be obtained by the following method.

The insulated wire is cut off vertically in the longitudinal direction of the insulated wire, and the cross-section thereof is processed by an ion milling treatment. The cross section (100 μm×150 μm) of the flattened-bubble-containing insulating layer obtained in this way is observed using a scanning electron microscope (SEM), to obtain an image of the cross-section. In a case where the thickness of the flattened-bubble-containing insulating layer is less than 100 μm or in the like case, a plurality of images of the cross-section is used so as to be the above-described cross-sectional area.

An arbitrary bubble is selected in the image of the cross-section obtained, and the thickness direction of the flattened-bubble-containing insulating layer in which the selected bubble is contained is designated as a y axis direction (vertical direction) and the direction perpendicular to the thickness direction is designated as a x axis direction (horizontal direction).

Next, a rectangular shape circumscribed around the cross-sectional shape of the bubble is drawn so that one side of the rectangular shape is parallel to the above-described x axis. Then, the length of one side of this rectangular shape in the x axis direction (horizontal direction) is measured as a Feret horizontal diameter, while the length of one side thereof in the y axis direction (the thickness direction of the flattened-bubble-containing insulating layer) is measured as a Feret vertical diameter. On the basis that the Feret horizontal diameter is a length of the cross-sectional shape of the bubble in the lateral direction and the Feret vertical diameter is a length of the cross-sectional shape of the bubble in the longitudinal direction, a ratio of the Feret horizontal diameter divided by the Feret vertical diameter is defined as a horizontal to vertical ratio.

In this way, on view of arbitrary bubbles, the horizontal to vertical ratio of the bubble is calculated. An average value of the horizontal to vertical ratios of 20 bubbles each of which has a horizontal to vertical ratio of 1.5 or more and 5.0 or less is defined as an oblateness. Those with unclear boundaries between bubbles are excluded from measurement (such bubbles are not observed as those for calculating the oblateness). Further, in a case where the insulated wire is a rectangular wire (rectangular cross-section), bubbles at the corner thereof are excluded from measurement.

In the flattened-bubble-containing insulating layer, the ratio of the flattened bubbles among bubbles contained in the flattened-bubble-containing insulating layer (the number of flattened bubbles/(sum of the number of flattened bubbles and the number of bubbles other than the flattened bubbles)) is not limited in particular. However, the ratio is preferably 50% or more, and more preferably 60% or more. If the ratio is 50% or more, wire breakdown voltage can be more increased while maintaining a partial discharge inception voltage. The upper limit thereof is not particularly limited and is preferably 100%.

The ratio of the flattened bubbles can be obtained as follows.

As is the case with the oblateness, an image of cross-section is obtained to observe 20 bubbles arbitrarily selected. With respect to each of the bubbles, a horizontal to vertical ratio of the bubble is calculated. A ratio of the number of bubbles each of which meets the oblateness of 1.5 or more and 5.0 or less to the number of observed bubbles (20) in total is defined as the ratio of the flattened bubbles. Those with unclear boundaries between bubbles are excluded from measurement. Further, in a case of a rectangular wire, bubbles at the corner thereof are excluded from measurement.

The porosity (void ratio) of the flattened-bubble-containing insulating layer is preferably 70% or less, and more preferably 60% or less, from the viewpoint of mechanical strength of the flattened-bubble-containing insulating layer. By setting the porosity to 70% or less, a partial discharge inception voltage and dielectric breakdown voltage can be more increased. Further, the ratio of the thermosetting resin in the flattened-bubble-containing insulating layer to the thickness thereof becomes high, which results in improvement of flexibility. In terms of exhibiting higher dielectric breakdown voltage due to reduction in relative permittivity, the flattened-bubble-containing insulating layer has a porosity of preferably 10% or more, more preferably 20% or more, and still more preferably 30% or more.

The porosity of the flattened-bubble-containing insulating layer can be adjusted by a foaming ratio, a resin concentration in a varnish, viscosity, a temperature in varnish coating, an addition amount of the foaming agent, a temperature of the baking oven, or the like.

The porosity of the flattened-bubble-containing insulating layer can be obtained as follows.

The bulk density (D2) of the flattened-bubble-containing insulating layer after bubble formation (foam formation) and the bulk density (D1) of the layer at the same portion before bubble formation (foam formation) are measured and the porosity can be calculated from the following formulae.

$$\text{Foaming ratio}=(D1/D2)\times 100(\%)$$

$$\text{Porosity}=\{(\text{Foaming ratio}-100)/\text{Foaming ratio}\}\times 100(\%)$$

Further, the bulk density is determined in accordance with Method A (water displacement method) in "Plastics—Methods of determining the density and relative density of non-cellular plastics" in JIS K 7112 (1999). Specifically, a density-measurement kit attached to Electronic Balance SX64 manufactured by Mettler Toledo International Inc. is used, and methanol is used as an immersion fluid. A flattened-bubble-containing insulating layer of the insulated wire and the same portion of the layer before bubble formation (foam formation) are peeled off, respectively, and the resultant samples are taken as test specimens, and the density ($\rho_{s,t}$) of each test specimen is calculated from the following calculation formula.

$$\text{Bulk density of test specimen } \rho_{S,t}=(m_{S,A}\times\rho_{IL})/(m_{S,A}-m_{s,IL})$$

Herein, $m_{S,A}$ is mass (g) of the test specimen measured in the air, $m_{s,IL}$ is mass (g) of the test specimen measured in the immersion fluid, and $\rho_{IL}$ is density (g/cm$^3$) of the immersion fluid.

The average bubble diameter of the bubbles in the flattened-bubble-containing insulating layer, although it is not limited in particular, is preferably 10 μm or less, more preferably 5 μm or less, and still more preferably 2 μm or less, in terms of an average of equivalent-circle diameters.

The bubble diameter can be determined by the following method.

The insulated wire is cut off vertically in the longitudinal direction of the insulated wire and the cross-section thereof is processed by an ion milling treatment. The cross section (100 μm×150 μm) of the flattened-bubble-containing insulating layer obtained in this way is observed using a scanning electron microscope (SEM). The diameters of 20 bubbles arbitrarily selected are measured using an image size-measuring software (WinROOF, manufactured by Mitani Corporation) in a diameter measuring mode, to obtain an equivalent-circle diameter of each bubble. The average of these bubble diameters is defined as a bubble diameter. Those with unclear boundaries between bubbles are excluded from the measurement.

The flattened-bubble-containing insulating layer contains a thermosetting resin. That is, the flattened-bubble-containing insulating layer is a bubble-containing layer composed of a thermosetting resin.

The thermosetting resin contained in the flattened-bubble-containing insulating layer is not limited in particular, as long as it is usually used for insulated wires and bubbles can be formed using the resin.

For example, such a thermosetting resin can be mentioned as: polyimide, polyamideimide, polyesterimide, polyetherimide, polyamide, polyurethane, polyhydantoin, polyimide hydantoin-modified polyester, polyester, polybenzimidazole, a melamine resin, formal, polyvinylformal, an epoxy resin, a phenolic resin, and a urea resin. Moreover, two or more kinds of these may be combined and used.

As the thermosetting resin, polyester, polyesterimide, polyimide, or polyamideimide, or any of combinations of these, is preferred.

The thickness of the flattened-bubble-containing insulating layer is not particularly limited, and is preferably 10 μm or more and 250 μm or less, and more preferably 30 μm or more and 200 μm or less. If the thickness thereof is within the above-described range, dielectric breakdown voltage can be more increased, while maintaining a partial discharge inception voltage, and further excellent flexibility is obtained.

The thickness of the flattened-bubble-containing insulating layer can be determined from a photograph of a cross section of the insulated wire by a scanning electron microscope (SEM).

<Conductor>

Anything that has conductivity can be used as a conductor, and commonly used conductors can be used without any particular limitation. Examples of such conductors include those composed of copper, copper alloys, aluminum, aluminum alloys, or the like.

A cross-sectional shape of the conductor can be selected from a circular shape (round), a rectangular shape (rectangular), a hexagonal shape, or the like, depending on the applications.

A size of the conductor is determined according to the application, and is not particularly limited. In the case of a conductor with a round cross-sectional shape, the size is preferably 0.3 to 3.0 mm, and more preferably 0.4 to 2.7 mm in terms of a diameter. In the case of a conductor with a rectangular cross-sectional shape, a width (long side) is preferably 1.0 to 5.0 mm, and more preferably 1.4 to 4.0 mm, and a thickness (short side) is preferably 0.4 to 3.0 mm, and more preferably 0.5 to 2.5 mm. However, a range of the conductor size in which advantageous effects of the present invention are obtained is not limited thereto.

Moreover, in the case of the conductor with a rectangular cross-section (rectangular shape), although the shape also varies according to the applications, a rectangular cross-section is more general than a square cross-section.

<Other Constitution>

The insulated wire of the present invention should have at least one flattened-bubble-containing insulating layer, and may have a coating layer(s) other than the flattened-bubble-containing insulating layer.

For example, the insulated wire may have a coating layer inside the flattened-bubble-containing insulating layer. As described in Japanese Patent No. 4177295, it may be possible to provide, on the periphery of a conductor, a thermosetting resin layer (so-called an enamel layer) that is able to maintain high adhesion to the conductor and high heat resistance of the film, and further to provide a flattened-bubble-containing insulating layer on the outer periphery thereof.

Further, on the outer periphery of the flattened-bubble-containing insulating layer, an insulating layer that does not have any bubbles (outer non-bubble-containing insulating layer) may be provided. In the present invention, the phrase "does not have any bubbles" means to include an embodiment in which no bubbles exist in the cross-section perpendicular to the direction of axis of the insulated wire, and in addition to this embodiment, another embodiment in which bubbles exist to the extent that the effects of the present invention or the function of the outer non-bubble-containing insulating layer would not be impaired.

The outer non-bubble-containing insulating layer is usually formed of a resin or a resin composition. The resin is not particularly limited and preferably includes at least one thermoplastic resin selected from polyphenylene sulfide (PPS) and polyetherether ketone (PEEK), or at least one thermosetting resin selected from polyimide (PI) and polyamideimide (PAI).

The thickness of the outer non-bubble-containing insulating layer is not particularly limited, and is preferably 20 μm to 150 μm.

The insulated wire of the present invention allows more increase in dielectric breakdown voltage, while maintaining a partial discharge inception voltage. By making bubbles into flattened ones, a ratio of the thermosetting resin portion to the bubble (void) portion in the thickness direction of the flattened-bubble-containing insulating layer becomes relatively higher than the insulating layer having bubbles of perfect circle. Therefore, it is thought that, due to relative permittivity reduced by containing bubbles, dielectric breakdown voltage can be more increased while maintaining a partial discharge inception voltage. Further, by the fact that the bubble-containing insulating layer contains bubbles having the above-described oblateness, flexibility can be further maintained in addition to the above-described characteristics. As described above, since the ratio of the thermoplastic resin portion in the thickness direction becomes relatively higher, it is thought that flexibility is excellent in this case.

<<Method of Producing Insulated Wire>>

The method of producing the insulated wire of the present invention is described.

The insulated wire of the present invention can be produced in the same manner as a method of producing ordinary insulated wires, except for a method of forming a flattened-bubble-containing insulating layer.

The method of forming a flattened-bubble-containing insulating layer is described.

<Method of Forming a Flattened-Bubble-Containing Insulating Layer>

The method of forming a flattened-bubble-containing insulating layer is not particularly limited, as long as it is a method capable of forming, on the periphery of a conductor, a bubble-containing insulating layer having specific flattened bubbles as described above. Examples of the method of forming a flattened-bubble-containing insulating layer include 1) a method of forming a bubble-containing insulating layer on the periphery of a conductor using a thermosetting resin, and then compressing the bubble-containing insulating layer obtained, to thereby form a flattened-bubble-containing insulating layer (compression method), and 2) a method of forming thermally decomposable resin particles with a flattened shape, mixing the thermally decomposable resin particles with a thermosetting resin to form a mixture, forming a coating layer on the periphery of a conductor using the mixture, and then subjecting the thermally decomposable resin to thermal decomposition, to thereby complete a flattened-bubble-containing insulating layer (pyrolysis method). In these methods, the bubble-containing insulating layer can be provided directly or indirectly on the periphery of the conductor.

In the above-described compression method, typical methods to obtain a bubble-containing insulating layer are 1-1) a method of adding a bubble-forming agent of an organic solvent for forming bubbles to a thermosetting resin for forming the bubble-containing insulating layer, to thereby form a composition, coating the composition on a conductor, and then vaporizing the bubble-forming agent by heating the composition coated, to thereby form bubbles in the resin (method by a bubble-forming agent), and 1-2) a method of impregnating a gas or a liquid into a thermosetting resin for forming a bubble-containing insulating layer, and then forming bubbles by heating. In addition to these, there is 1-3) a method of containing a foam nucleating agent to a thermosetting resin for forming a bubble-containing insulating layer, and then causing bubbles by irradiation of ultraviolet rays, and the like. These methods can be performed according to the description of <forming of bubble-containing insulating layer> of International Publication No. 2015/137342, and the description thereof is incorporated herein by reference.

Examples thereof other than the above-described methods 1-1) to 1-3) include a method of forming a bubble-containing insulating layer having bubbles with a cross-section having an almost perfect circle according to the pyrolysis method described below, and then compressing this layer, to thereby obtain a flattened-bubble-containing insulating layer.

Among these methods, a method by a bubble-forming agent is preferable. Hereinafter, details of the method by a bubble-forming agent, which is a preferable method, is explained in a concise manner. However, for the details thereof, reference can be made to the above-described International Publication No. 2015/137342.

(Method by a Bubble-Forming Agent)

In this method, it is preferable to add a bubble-forming agent to a thermosetting resin for forming a bubble-containing insulating layer, to prepare a coating composition, and then to cover a conductor with the coating composition, for example, by coating it thereon, and then to form bubbles by heat.

The bubble-forming agent is a high-boiling point solvent having a boiling point of 180° C. to 300° C., more preferably 210° C. to 260° C., and the high-boiling point solvent is preferably an organic solvent. As a bubble-forming agent, specifically, such a solvent can be used as: diethylene glycol dimethyl ether, triethylene glycol dimethyl ether, diethylene glycol dibutyl ether, tetraethylene glycol dimethyl ether, and tetraethylene glycol monomethyl ether.

With respect to the high-boiling point solvent as the bubble-forming agent, one kind thereof may be used alone, but in view of obtaining an effect in which foam is generated in a wide temperature range, at least two kinds are preferably combined and used.

In the coating composition, beside the bubble-forming agent, organic solvents used for forming the resin varnish (turning the resin into varnish) are generally used. In this case, the high-boiling point solvent as the bubble-forming agent preferably has a boiling point higher than the boiling point of the solvent for forming the resin varnish described later, and when one kind of the high-boiling point solvent as the bubble-forming agent is used alone, the high-boiling point solvent as the bubble-forming agent preferably has a boiling point higher by 10° C. or more than that of the solvent for forming the resin varnish. In addition, when one kind of the high-boiling point solvent as the bubble-forming agent is used alone, the high-boiling point solvent has both roles of a bubble-nucleating agent and a foaming agent. On the other hand, when two or more kinds of the high-boiling point solvents as the bubble-forming agent are used, a high-boiling point solvent having the highest boiling point acts as the foaming agent, and a high-boiling point solvent having an intermediate boiling point and for forming the bubbles acts as the bubble-nucleating agent.

The organic solvent to be used for forming the resin varnish is not particularly restricted, as long as the solvent does not adversely affect a reaction of the thermosetting resin. Examples thereof include: an amide-based solvent, such as N-methyl-2-pyrrolidone (NMP), N,N-dimethylacetamide (DMAC), dimethyl sulfoxide, and N,N-dimethylformamide; a urea-based solvent, such as N,N-dimethylethyleneurea, N,N-dimethylpropyleneurea, and tetramethylurea; a lactone-based solvent, such as γ-butyrolactone and γ-caprolactone; a carbonate-based solvent, such as propylene carbonate; a ketone-based solvent, such as methyl ethyl ketone, methyl isobutyl ketone, and cyclohexanone; an ester-based solvent, such as ethyl acetate, n-butyl acetate, butyl cellosolve acetate, butyl carbitol acetate, ethyl cellosolve acetate, and ethyl carbitol acetate; a glyme-based solvent, such as diglyme, triglyme, and tetraglyme; a hydrocarbon-based solvent, such as toluene, xylene, and cyclohexane; and a sulfone-based solvent, such as sulfolane. A boiling point of the organic solvent to be used for forming the resin vanish is preferably 160° C. to 250° C., and more preferably 165° C. to 210° C.

The bubbles are formed thereon by baking the coating composition covered on the conductor, in the baking furnace.

Although specific baking conditions are influenced by a shape of the furnace to be used and the like, if a natural convection-type vertical furnace of about 5 m is applied, the coating composition can be formed into the insulating layer including bubbles by conducting baking at a furnace temperature of 500 to 520° C. Moreover, as a time of passing through the furnace, 10 to 90 seconds are usual.

In addition, the coating composition may contain, in addition to the above, when necessary, any of various additives, such as an antioxidant, an antistatic agent, a ultraviolet radiation inhibitor, a light stabilizer, a fluorescent whitening agent, a pigment, a dye, a compatibilizer, a lubricant, a reinforcing agent, a flame retardant, a crosslinking agent, a crosslinking coagent, a plasticizer, a thickening agent, a viscosity reducer, and an elastomer.

In the present invention, a bubble-containing insulating layer is compressed into a flattened-bubble-containing insulating layer.

Compression can be performed by compression molding, rolling, or the like. It is preferable to mold the bubble-containing insulating layer by compressing it in the thickness direction. Compression can be performed using, for example, a pressing machine (for example, FSP1-600S, manufactured by Fuji Steel Industry Ltd.), a roller (Rolling roller (for example, roll shape φ100×width 50 mm)), and the like.

The condition of the compression varies depending on materials, and therefore cannot be determined unambiguously. However, by ordinary, flattened bubbles having high oblateness can be formed in the bubble-containing insulating layer by increasing a pressure applied to the bubble-containing insulating layer and/or lengthening a compression time. Further, the rate of flattened bubbles can be set appropriately. For example, in the above-described press method, in a case of using materials and the like as used in Examples described below, an insulated wire having flattened bubbles can be obtained by pressurization of 100 MPa and depressurization after retention of 60 seconds. In the roller method, in a case of using materials and the like as used in Examples, an insulated wire having flattened bubbles can be obtained by setting so that a rolling load is 100 MPa, and then compressing it with rollers from two directions of thickness direction and width direction.

The thickness of the bubble-containing insulating layer before compression cannot be completely set depending on compressibility (compression ratio), oblateness, and the like. However, for example, the bubble-containing insulating layer before compression is formed so as to have a thickness that meets the following ratio (compression ratio) of thicknesses before and after compression.

Compression ratio=(the thickness of the bubble-containing insulating layer after compression/the thickness of the bubble-containing insulating layer before compression)×100(%)

Specifically, the thickness of the bubble-containing insulating layer after compression is preferably from 40 to 95%, more preferably from 50 to 95%, and still more preferably from 50 to 90%, with respect to the thickness thereof before compression.

The compression is performed over the entire circumference of the conductor in the longitudinal direction, to form flattened bubbles along the entire circumference. Flattened bubbles that meet the above-described oblateness can be obtained by compression. It is preferable that the cross-section of the flattened bubbles that is perpendicular to the thickness direction of the bubble-containing insulating layer has an almost circular shape.

By appropriately changing the formation conditions of the above-described bubble-containing insulating layer and the compression conditions of the bubble-containing insulating layer, porosity, oblateness, bubble diameter, and the ratio of the flattened bubbles can be appropriately set.

The pyrolysis method (thermal decomposition method) can be performed by using a thermosetting resin used for forming the above-described flattened-bubble-containing insulating layer, according to a method of using a thermally decomposable resin, which is described in JP-A-2012-224714. In the present invention, however, the pyrolysis method is performed by preliminarily making the thermally decomposable resin into thermally decomposable resin particles having almost the same shape and almost the same size as a desired shape and size of the flattened bubble, and then subjecting these particles to thermal decomposition.

As the thermally decomposable resin, use can be made of those described in JP-A-2012-224714, and preferred are (meth)acrylic polymers (polymethyl methacrylate, and the like) and their crosslinked products (cross-linked (meth) acrylic polymers, cross-linked poly(meth)acrylic acid esters, including, for example, cross-linked polymethyl methacrylate and cross-linked polybutyl methacrylate), and the like.

The shape of the thermally decomposable resin particles is not particularly limited, as long as it is a shape which is capable of forming the above-described flattened bubbles. It is preferable to make the shape into the shape which meets the above-described oblateness, and it is more preferable to make the shape into the shape capable of forming bubbles with the bubble diameter described about the above-described flattened bubbles.

The thermally decomposable resin particles may be prepared by any method capable of making into the above-described shape, and the preparation may be performed by ordinary methods. For example, the thermally decomposable resin particles may be prepared by compressing thermally decomposable resin particles with a shape of true sphere from above until a predetermined load (maximum load 100N) for a predetermined time (for example, 60 seconds), and then after reaching the predetermined load, conducting depressurization at the same speed without holding the load, to thereby complete the shape transformation. Alternatively, pre-flattened thermally decomposable resin particles (for example, ASF-7 (trade name), manufactured by TOYOBO CO., LTD) may be used.

The insulated wires of the present invention can be used as insulated wires for the purpose in which a high voltage is applied. The insulated wire of the present invention can be used in various electrical equipment and electronic equipment. In particular, the insulated wire of the present invention can be processed into a coil and used in a motor, a transformer, and the like, and can constitute high performance electrical equipment. Above all, the insulated wire is preferably used as a winding wire for a driving motor of HV (hybrid vehicle) or EV (electric vehicle).

EXAMPLES

The present invention will be described in more detail based on examples given below, but the invention is not meant to be limited by these.

In the following way, insulated wires with the configuration shown in FIG. 1 were produced as insulated wires of Examples 1 to 8, 12, 13 and Comparative Examples 1, 2, 4 and 5. Further, in the following way, insulated wires with the configuration shown in FIG. 2 were produced as insulated wires of Examples 9 to 11.

Examples 1-5, 8-10, 12, and 13, and Comparative Examples 1, 2, and 5

Example 1

Polyamideimide (PAI) [trade name: HI-406, containing 32% by mass of the resin component, solvent: N-methyl-2-pyrrolidone (NMP) solution, manufactured by Hitachi Chemical Co., Ltd.] was put in a 2 L-separable flask, and tetraethylene glycol dimethyl ether and triethylene glycol dimethyl ether as bubble-forming agents were added to this solution, to obtain a PAI varnish. This PAI varnish was applied onto a periphery of a rectangular conductor (copper having an oxygen content of 15 ppm) having a rectangular cross section (long side 3.86 mm×short side 2.36 mm, r=0.3 mm in a curvature radius of chamfering of four corners), and the resultant conductor was baked at a furnace temperature of 500° C., to form a bubble-containing insulating layer (thickness of 48 μm). Using a press machine (FSP1-600S, manufactured by Fuji Steel Industry Ltd.), the bubble-containing insulating layer was compressed by holding it for 60 seconds under pressure of 100 MPa, to thereby make the thickness into 40 μm (compression ratio: 83%). In this way, an insulated wire having a flattened-bubble-containing insulating layer was obtained.

Example 2

Polyimide (PI) [trade name: U-imide, a NMP solution containing 25% by mass of the resin component, manufactured by UNITIKA LTD.] was put in a 2 L-separable flask, and tetraethylene glycol dimethyl ether as a bubble-forming agent was added to this solution, to obtain a PI varnish. A bubble-containing insulating layer was formed by coating the above-described PI varnish on the same conductor as in Example 1, and then baking the varnish at furnace temperature of 540° C. in the first half and at furnace temperature of 520° C. in the latter half. Using the same press machine as in Example 1, the bubble-containing insulating layer was compressed, to thereby make the thickness into 100 μm. In this way, an insulated wire having a flattened-bubble-containing insulating layer was obtained.

Example 3

An insulated wire having a flattened-bubble-containing insulating layer was obtained in the same manner as in Example 1, except that a bubble-containing insulating layer prepared by adjusting a blended amount of a bubble-forming agent so that the porosity would become the value shown in Table 1 was set to the thickness shown in Table 1 by compressing the bubble-containing insulating layer from two directions of thickness direction and width direction, by the setting of the rolling load to 100 MPa using a roller (roll shape φ100×width 50 mm).

Examples 4, 5 and 13, and Comparative Example 2

Insulated wires each having a flattened-bubble-containing insulating layer was obtained in the same manner as in Example 2, except that a bubble-containing insulating layer prepared by adjusting a blended amount of a bubble-forming agent so that the porosity would become the value shown in Table 1 was set to the thickness shown in Table 1 by compressing.

Examples 8 and 12, and Comparative Examples 1 and 5

Insulated wires each having a flattened-bubble-containing insulating layer was obtained in the same manner as in Example 1, except that a bubble-containing insulating layer prepared by adjusting a blended amount of a bubble-forming agent so that the porosity would be the value shown in Table 1 was set to the thickness shown in Table 1 by compressing.

Example 9

A flattened-bubble-containing insulating layer was formed in the same manner as in Example 2, except that a bubble-containing insulating layer prepared by adjusting a blended amount of a bubble-forming agent so that the porosity would be the value shown in Table 1 was set to the thickness shown in Table 1 by compressing.

On the outer periphery of the flattened-bubble-containing insulating layer obtained, an outer non-bubble-containing insulating layer composed of a thermoplastic resin was formed using an extruder (a diameter 30 mm-full-flight screw in which L/D=20 and a compression ratio was 3), as described below. Polyphenylene sulfide (PPS) (trade name: FZ-2100, manufactured by DIC Corporation) was used as a thermoplastic resin. Extrusion coating of PPS was performed by using an extrusion die, so that an outer shape of a cross section of the extrusion-coating resin layer would be analogous to the shape of the conductor, thereby forming the outer non-bubble-containing insulating layer having a thickness of 40 μm. In this way, an insulated wire having the flattened-bubble-containing insulating layer and the outer non-bubble-containing insulating layer was obtained.

Example 10

A flattened-bubble-containing insulating layer was formed in the same manner as in Example 1, except that a bubble-containing insulating layer prepared by adjusting a blended amount of a bubble-forming agent so that the porosity would be the value shown in Table 1 was set to the thickness shown in Table 1 by compressing.

On the outer periphery of the flattened-bubble-containing insulating layer obtained, an outer non-bubble-containing insulating layer composed of a thermoplastic resin was formed using an extruder (a diameter 30 mm-full-flight screw in which L/D=20 and a compression ratio was 3), as described below. Polyether ether ketone (PEEK) (trade name: KetaSpire KT-820, manufactured by Solvay Specialty Polymers Japan K.K.) was used as a thermoplastic resin, and extrusion coating of PEEK was performed by using an extrusion die, so that an outer shape of a cross section of the extrusion-coating resin layer would be analogous to the shape of the conductor, thereby to form the outer non-bubble-containing insulating layer having a thickness of 50 μm. In this manner, an insulated wire having a flattened-bubble-containing insulating layer and the outer non-bubble-containing insulating layer was obtained.

Comparative Example 3

Polyamideimide (PAI) [trade name: HI-4065A, a solution containing 32% by mass of the resin component in a solvent: N-methyl-2-pyrrolidone (NMP), manufactured by Hitachi Chemical Co., Ltd.] was coated on the same conductor as in Example 1. This was baked at furnace temperature of 540° C. in the first half and at furnace temperature of 520° C. in the latter half, and to prepare an insulated wire having a coating thickness of 30 μm. The insulated wire prepared does not have a bubble-containing insulating layer because a bubble-forming agent was not added thereto.

Examples 6, 7 and 11, and Comparative Example 4

Example 6

Into a 2 L-separable flask, was put polyamideimide (PAI) [trade name: HI-406SA, a solution containing 32% by mass of the resin component in a solvent: N-methyl-2-pyrrolidone (NMP), manufactured by Hitachi Chemical Co., Ltd.], and a crosslinked polymethylmethacrylate [trade name: SSX-102, particle diameter 2.5 μm, manufactured by SEKISUI KASEI CO., Ltd.] of a thermally decomposable resin as a bubble-forming agent was added thereto and mixed thoroughly with stirring, to thereby obtain a thermally decomposable resin-containing polyamideimide varnish. On the same conductor 1 as in Example 1, the thermally decomposable resin-containing polyamideimide varnish prepared above was coated and baked at furnace temperature of 540° C. in the first half and at furnace temperature of 520° C. in the latter half. A bubble-containing insulating layer was formed by decomposing the thermally decomposable resin. The bubble-containing insulating layer prepared was compressed using a press machine to make the thickness into 30 μm. In this way, an insulated wire having the flattened-bubble-containing insulating layer was obtained.

Example 7

An insulated wire having a flattened-bubble-containing insulating layer was obtained in the same manner as in Example 6, except that use was made of particles of the above-described crosslinked polymethylmethacrylate which particles were preliminarily rolled from one direction using a press machine so that the oblateness would be 1.5 or more and 5.0 or less, and compression of the bubble-containing insulating layer by a press machine was not performed.

Example 11

A flattened-bubble-containing insulating layer was formed in the same manner as in Example 2, except that a bubble-containing insulating layer prepared by adjusting a blended amount of a bubble-forming agent so that the porosity would be the value shown in Table 1 was set to the thickness shown in Table 1 by compressing.

On the periphery of the flattened-bubble-containing insulating layer obtained, a polyimide with no addition of a bubble-forming agent was baked, to thereby form a 50 μm-thick outer non-bubble-containing insulating layer.

In this way, an insulated wire having the flattened-bubble-containing insulating layer and the outer non-bubble-containing insulating layer was obtained.

Comparative Example 4

Into a 2 L-separable flask, was put polyamideimide (PAI) [trade name: HI-406SA, a solution containing 32% by mass of the resin component in a solvent: N-methyl-2-pyrrolidone (NMP), manufactured by Hitachi Chemical Co., Ltd.], and a crosslinked polybutylmethacrylate [trade name: BM30X-5, particle diameter: 5.0 μm, manufactured by SEKISUI KASEI CO., Ltd.] of a thermally decomposable resin as a bubble-forming agent was added thereto and mixed thoroughly with stirring, to thereby obtain a thermally decomposable resin-containing insulating varnish. On the same conductor 1 as in Example 1, the thermally decomposable resin-containing polyamideimide varnish prepared above was coated and baked at furnace temperature of 540° C. in the first half and at furnace temperature of 520° C. in the latter half. A bubble-containing insulating layer was formed by decomposing the thermally decomposable resin, and an insulated wire having the thickness of the bubble-containing insulating layer was 43 μm was prepared.

(The Thicknesses of the Bubble-Containing Insulating Layer and the Outer Non-Bubble-Containing Insulating Layer)

The thicknesses of the bubble-containing insulating layer and the outer non-bubble-containing insulating layer were measured according to the above-described method of measuring the thickness of the flattened-bubble-containing insulating layer.

(Porosity)

The porosity of the bubble-containing insulating layer of each insulated wire were measured according to the above-described method of measuring the porosity.

(Bubble Oblateness)

The bubble oblateness in the bubble-containing insulating layer of each insulated wire were measured according to the above-described method of measuring the oblateness.

(Diameter of Bubbles)

The diameter of the bubbles in the bubble-containing insulating layer of each insulated wire were measured according to the above-described method of measuring the diameter of the bubbles.

(Ratio of Flattened Bubbles)

A ratio of the flattened bubbles in the flattened-bubble-containing insulating layer of the insulated wires produced in Examples and in the bubble-containing insulating layer of the insulated wires produced in Comparative Examples was measured respectively according to the above-described method of measuring a ratio of the flattened bubble.

The following characteristics of the insulated wires obtained were evaluated.

(Dielectric Breakdown Voltage)

Evaluation of the dielectric breakdown voltage was conducted in accordance with the following conductive copper foil tape method.

The insulated wire prepared above was cut off to a proper length (length of about 20 cm), and a conductive copper foil tape having a width of 20 mm was wound near the center of the insulated wire. An alternating-current voltage having a 50 Hz sine wave was applied between the copper foil and the conductor, and a dielectric breakdown was caused with continuous raise in voltage. The voltage (effective value) was measured. Measurement was conducted 20 times. The average value thereof divided by a minimum film thickness observed by a cross-section measurement (in a case of having an outer non-bubble-containing insulating layer, a minimum sum of the bubble-containing insulating layer and the outer non-bubble-containing insulating layer) was defined as a dielectric breakdown strength (kV/mm).

Meanwhile, the measurement was conducted at a temperature of 25'C.

In this test, the insulated wire exhibiting a dielectric breakdown voltage of 150 kV/mm or more was judged as "pass".

(Partial Discharge Inception Voltage)

An insulated wire was sandwiched with 2 sheets of stainless plates (also called as SUS plates) and compression of 1 MPa was applied thereto using a universal material testing machine (trade name: AUTOGRAPH AGS-H, manufactured by SHIMADZU CORPORATION). A ground electrode was wired on one of the SUS plates and a high-voltage electrode was wired on the conductor, and then using a partial discharge inception voltage tester (trade name: KPD2050, manufactured by Kikusui Electronics Corporation), an alternating-current voltage having a 50 Hz sine wave was applied, and the voltage (effective value) was measured when a discharged charge amount was 10 pC while continuously boosting the voltage. The measurement was conducted under the conditions of 25° C. and 50% RH. The partial discharge inception voltage depends on the thickness of the entire insulating layers (the total amount of the coating thickness of the bubble-containing insulating layer and the thickness of the outer non-bubble-containing insulating layer of Table 1). However, it can be said that, if the conversion value according to the following conversion formula is 600V or more when the thickness of the entire insulating layers is 50 μm, partial discharge is unlikely caused. Therefore, the evaluation in terms of the above converted value was conducted in such manner that the case of 650V or more was ranked as "A", the case of 600 to 649V was ranked as "B", and the case of less than 600V was ranked as "C".

Conversion formula: Conversion when set to 50 μm was conducted according to the following Dakin's empirical formula.

$$V=163(t/\varepsilon)^{0.46}$$

In the above-described empirical formula, V denotes a partial discharge inception voltage, t denotes a thickness of the entire insulating layers, and £ denotes a relative permittivity of the entire insulating layers.

The relative permittivity of the entire insulating layers is a value calculated from the electrostatic capacitance of the insulated wire and the outer diameters of the conductor and the insulated wire, using the following formula.

$$\text{Formula: } \varepsilon r^*=Cp\cdot\mathrm{Log}(b/a)/(2\pi\varepsilon_0)$$

Herein, εr* denotes relative permittivity of the entire insulating layers, Cp denotes the electrostatic capacitance [pF/m] per unit length, a denotes the outside diameter of the conductor, b denotes the outside diameter of the insulated wire, and $\varepsilon_0$ denotes the vacuum permittivity ($8.855\times10^{-12}$ [F/m]), respectively.

Using an LCR Hi-Tester (manufactured by Hioki E.E. Corporation, model 3532-50 (trade name: LCR HiTESTER)) and an insulated wire left to stand in a dry air at an ordinary temperature (25° C.) for 24 hours or more, and setting a measurement temperature to 25° C. and 250° C., the electrostatic capacitance of the insulated wire was measured when the temperatures became constant after placing the insulated wire in a thermostat set to predetermined temperatures.

In a case where the cross-section of the insulated wire is non-circular, for example, rectangular, "the relative permittivity of the entire insulating layers" can be calculated by using the formula that the electrostatic capacitance Cp of the entire insulating layer is a sum of the electrostatic capacitance Cf of the flat portion and the electrostatic capacitance Ce of the corner (Cp=Cf+Ce). Specifically, if lengths of a long side and a short side in a linear part of the conductor are taken as L1 and L2, respectively, a curvature radius of a conductor corner is taken as R, and a thickness of the whole of the electrical wire coating is taken as T, the electrostatic capacitance Cf in the flat part and the electrostatic capacitance Ce in the corner part are represented by the following formulas, respectively. From the following formulas, and actually measured electrostatic capacitance of the insulated wire, and the electrostatic capacitance of the entire insulating layer: Cp=(Cf+Ce), εr* was calculated.

$$Cf=(\varepsilon r^*/\varepsilon_0)\times 2\times(L1+L2)/T$$

$$Ce=(\varepsilon r^*/\varepsilon_0)\times 2\pi\varepsilon_0/\mathrm{Log}\{(R+T)/R\}$$

(Flexibility)

The flexibility of each insulated wire produced was evaluated as described below.

The outer appearance of the insulating layer outer layer (that is a bubble-containing insulating layer, and in a case where the insulated wire has an outer non-bubble-containing insulating layer, that is the outer non-bubble-containing insulating layer) of the insulated wire wrapped around a cylinder with the same outer diameter as the short side length of the insulated wire was observed using a microscope (manufactured by Keyence Corporation, trade name: Microscope VHX-2000).

The test was carried out on 5 specimens.

In the evaluation, the case where there was no change in appearance in all of the 5 specimens was ranked as "A", the case where there was a change in color of the insulating layer outer layer in at least one specimen and crinkles occur on the bent outer part, which however does not affect practical characteristics was ranked as "B", the case where there was a change in color of the insulating layer outer layer in at least one specimen and crinkles are confirmed on an entire circumference of the bubble-containing insulating layer, which however does not affect practical characteristics was ranked as "C", and the case where cracks were displayed on at least one specimen, or a conductor was exposed was ranked as "D".

This test is a reference test.

TABLE 1

| | | Ex. 1 | Ex. 2 | Ex. 3 | Ex. 4 | Ex. 5 | Ex. 6 | Ex. 7 | Ex. 8 | Ex. 9 | Ex. 10 | Ex. 11 | Ex. 12 | Ex. 13 |
|---|---|---|---|---|---|---|---|---|---|---|---|---|---|---|
| Bubble-containing insulating layer | Resin | PAI | PI | PAI | PI | PI | PAI | PAI | PAI | PI | PAI | PI | PAI | PI |
| | Thickness(μm) | 40 | 100 | 70 | 20 | 30 | 30 | 110 | 260 | 40 | 100 | 30 | 40 | 20 |
| | Porosity (%) | 30 | 20 | 45 | 50 | 15 | 30 | 40 | 40 | 30 | 40 | 35 | 30 | 80 |
| | Bubble oblateness | 3.0 | 2.0 | 1.6 | 3.0 | 2 | 3.0 | 1.7 | 4.6 | 3.0 | 1.8 | 3.0 | 3.0 | 3.0 |
| | Diameter of bubbles | 2.2 | 3.6 | 1.8 | 3 | 2.2 | 2.5 | 1.6 | 1.6 | 2.2 | 1.6 | 2.2 | 2.2 | 3 |
| | Ratio of flattened bubbles (%) | 85 | 75 | 60 | 85 | 75 | 85 | 90 | 90 | 75 | 65 | 75 | 45 | 85 |
| Outer non-bubble-containing insulating layer | Resin | — | — | — | — | — | — | — | — | PPS | PEEK | PI | — | — |
| | Porosity (%) | — | — | — | — | — | — | — | — | 0 | 0 | 0 | — | — |
| | Thickness (μm) | — | — | — | — | — | — | — | — | 40 | 50 | 50 | — | — |
| Dielectric Breakdown Voltage (kV/mm) | | 160 | 155 | 150 | 155 | 175 | 150 | 160 | 170 | 180 | 175 | 170 | 155 | 150 |
| Partial Discharge Inception Voltage (V) | | B | B | B | B | B | B | B | B | A | A | A | B | B |
| Flexibility | | B | B | B | B | B | B | B | C | B | B | B | B | C |

Remarks: 'Ex' means Example according to this invention.

TABLE 2

| | | CEx. 1 | CEx. 2 | CEx. 3 | CEx. 4 | CEx. 5 |
|---|---|---|---|---|---|---|
| Bubble-containing insulating layer | Resin | PAI | PI | PAI | PAI | PAI |
| | Thickness(μm) | 40 | 100 | 30 | 43 | 50 |
| | Porosity (%) | 30 | 20 | 0 | 30 | 30 |
| | Bubble Oblateness | 1.2 | 1.3 | — | 1.3 | 1.2 |
| | Diameter of bubbles | 2.2 | 1.6 | — | 5.0 | 4.8 |
| | Ratio of flattened bubbles (%) | 12 | 20 | — | — | 30 |
| Outer non-bubble-containing insulating layer | Resin | — | — | | — | — |
| | Porosity (%) | — | — | | — | — |
| | Thickness (μm) | — | — | | — | — |
| Dielectric Breakdown Voltage (kV/mm) | | 148 | 145 | 180 | 142 | 132 |
| Partial Discharge Inception Voltage (V) | | B | B | C | A | B |
| Flexibility | | B | B | B | B | B |

Remarks: 'CEx' means Comparative Example.

From the results in Table 1, the followings are seen.

The insulated wires of Comparative Examples 1 to 5 each could not achieve a good balance between the dielectric breakdown voltage and the partial discharge inception voltage.

In contrast, the insulated wires of Examples 1 to 13, each of which has flattened bubbles with oblateness of 1.5 or more and 5.0 or less, exhibited higher dielectric breakdown voltage while maintaining the partial discharge inception voltage. In particular, in each of the insulated wires of Examples 1 and 2, the dielectric breakdown voltage was about 10 kV/mm higher than the insulated wires of Comparative Examples 1 and 2, which has bubbles with too low oblateness.

From comparison between Example 1 and Example 12, it is seen that in a case where the ratio of flattened bubbles is 50% or more, the dielectric breakdown voltage is higher.

From comparison between Example 2 and Example 13, it is seen that in a case where the porosity is 70% or less, more excellent effects are achieved in terms of dielectric breakdown voltage and flexibility.

Having described our invention as related to the present embodiments, it is our intention that the invention not be limited by any of the details of the description, unless otherwise specified, but rather be construed broadly within its spirit and scope as set out in the accompanying claims.

This application claims a priority on Patent Application No. 2018-068758 filed in Japan on Mar. 30, 2018, which is entirely herein incorporated by reference.

REFERENCE SIGNS LIST

10, 20 Insulated wire
1 Conductor
2 Flattened-bubble-containing insulating layer
3 Outer non-bubble-containing insulating layer
4 Flattened bubbles

The invention claimed is:

1. An insulated wire comprising:
a conductor,
a bubble-containing insulating layer, directly or indirectly coating an outer periphery of the conductor and containing a thermosetting resin, and
an outer non-bubble-containing insulating layer, directly or indirectly coating an outer periphery of the bubble-containing insulating layer,
wherein bubbles in the bubble-containing insulating layer include flattened bubbles whose oblateness in a cross-section perpendicular to a longitudinal direction of the insulated wire (lateral length of a bubble cross-sectional shape/vertical length of the bubble cross-sectional shape) is 1.5 or more and 5.0 or less, and
wherein a ratio of a number of flattened bubbles among bubbles contained in the bubble-containing insulating layer is 50% or more.

2. The insulated wire according to claim 1, wherein a porosity of the bubble-containing insulating layer is 70% or less.

3. The insulated wire according to claim 1, wherein the thermosetting resin is polyester, polyesterirnide, polyimide, or polyamideirnide, or a combination thereof.

4. The insulated wire according to claim 1, wherein a thickness of the bubble-containing insulating layer is 10 μm or more and 250 μm or less.

5. The insulated wire according to claim 1, wherein the flattened bubbles are formed by compression in a thickness direction of an insulating layer having bubbles.

6. The insulated wire according to claim 1, wherein the thermosetting resin is polyesterimide, polyimide, or polyamideimide, or a combination thereof.

* * * * *